US010982687B2

(12) United States Patent
Niwa et al.

(10) Patent No.: US 10,982,687 B2
(45) Date of Patent: Apr. 20, 2021

(54) HOUSING FOR TURBOCHARGER AND METHOD FOR MANUFACTURING THE SAME

(71) Applicant: OTICS CORPORATION, Nishio (JP)

(72) Inventors: Tetsuya Niwa, Aichi (JP); Tomoyuki Isogai, Aichi (JP)

(73) Assignee: OTICS CORPORATION, Nishio (JP)

( * ) Notice: Subject to any disclaimer, the term of this patent is extended or adjusted under 35 U.S.C. 154(b) by 475 days.

(21) Appl. No.: 15/922,303

(22) Filed: Mar. 15, 2018

(65) Prior Publication Data

US 2018/0313361 A1 Nov. 1, 2018

(30) Foreign Application Priority Data

Apr. 27, 2017 (JP) ..... JP2017-088189

(51) Int. Cl.
*F04D 29/42* (2006.01)
*F04D 29/44* (2006.01)
(Continued)

(52) U.S. Cl.
CPC ..... *F04D 29/441* (2013.01); *F01D 9/026* (2013.01); *F01D 25/24* (2013.01);
(Continued)

(58) Field of Classification Search
CPC ..... F04D 29/4206; F04D 29/4213; F04D 29/441; F04D 29/584; F04D 29/624;
(Continued)

(56) References Cited

U.S. PATENT DOCUMENTS 6,193,463 B1 * 2/2001 Adeff ..... F04D 29/023 415/196
6,779,515 B2 * 8/2004 Vaught ..... F01P 9/06 123/41.31
(Continued)

FOREIGN PATENT DOCUMENTS

JP 2002-256878 A 9/2002
JP 2004-011555 A 1/2004
(Continued)

OTHER PUBLICATIONS

Aug. 18, 2020 Office Action issued in Japanese Patent Application No. 2017-088189.
(Continued)

*Primary Examiner* — J. Todd Newton
(74) *Attorney, Agent, or Firm* — Oliff PLC

(57) ABSTRACT

A housing for a turbocharger that makes it possible to prevent sticking of deposit and attain satisfactory assembling workability and easy moldability by die casting. The housing dividably includes a scroll piece and a shroud piece, including an annular refrigerant flow path defined by a first flow-path formation part of the scroll piece and a second flow-path formation part of the shroud piece. The first and second flow path formation parts are fitted with each other at inner and outer circumferential seal parts for sealing the refrigerant flow path on inner and outer circumferential sides thereof. The inner circumferential seal part is formed by press-fitting a first press-fitting portion of the shroud piece into a first press-fitted portion of the scroll piece. The outer circumferential seal part is formed by press-fitting a second press-fitting portion of the shroud piece into a second press-fitted portion of the scroll piece.

20 Claims, 14 Drawing Sheets

(51) Int. Cl.
*F01D 9/02* (2006.01)
*F04D 29/58* (2006.01)
*F01D 25/24* (2006.01)

(52) U.S. Cl.
CPC ..... *F04D 29/4206* (2013.01); *F04D 29/4213* (2013.01); *F04D 29/584* (2013.01); *F05D 2220/40* (2013.01); *F05D 2230/21* (2013.01); *F05D 2260/20* (2013.01); *F05D 2260/37* (2013.01); *F05D 2260/607* (2013.01)

(58) Field of Classification Search
CPC ..... F01D 9/026; F01D 25/08; F01D 25/12; F01D 25/14; F01D 25/145; F05D 2220/40; F05D 2230/21; F05D 2260/20; F05D 2260/204; F05D 2260/205; F05D 2260/208; F05D 2260/213; F05D 2260/221; F05D 2260/37; F05D 2260/607
See application file for complete search history.

(56) References Cited

U.S. PATENT DOCUMENTS 7,179,051 B2 * 2/2007 Williams ..... F04D 29/4206 415/204
8,696,310 B2 * 4/2014 Dillon ..... F04D 29/4206 415/206
9,435,346 B2 * 9/2016 Osuka ..... F04D 29/023
9,695,780 B2 7/2017 Sadamitsu et al.
10,087,820 B2 10/2018 Uesugi et al.
10,584,709 B2 3/2020 Peer et al.
2015/0020783 A1 * 1/2015 Sadamitsu ..... F02M 26/09 123/568.12
2016/0273548 A1 * 9/2016 Uesugi ..... F04D 29/584
2016/0273551 A1 * 9/2016 Uesugi ..... F04D 29/4206
2017/0022999 A1 1/2017 Peer et al.

FOREIGN PATENT DOCUMENTS

JP 2014-058918 A 4/2014
JP 2014-122582 A 7/2014
JP 2016-176352 A 10/2016
JP 2016-176353 A 10/2016
WO 2013/132577 A1 9/2013

OTHER PUBLICATIONS

Dec. 15, 2020 Office Action issued in Japanese Patent Application No. 2017-088189.

* cited by examiner

HOUSING FOR TURBOCHARGER AND METHOD FOR MANUFACTURING THE SAME

CROSS-REFERENCE TO RELATED APPLICATION

The present application claims priority under 35 U.S.C. § 119 to Japanese Application No. 2017-088189, filed on Apr. 27, 2017, entitled "HOUSING FOR TURBOCHARGER AND METHOD FOR MANUFACTURING THE SAME". The contents of this application are incorporated herein by reference in their entirety.

BACKGROUND OF THE INVENTION

Field of the Invention

The present invention relates to a housing for a turbocharger and a method for manufacturing the same.

Description of the Related Art

A turbocharger to be mounted on an internal combustion engine of an automobile or the like includes a compressor impeller and a turbine impeller, which are housed in a housing. The compressor impeller is disposed in an air flow path that is formed inside of the housing. The air flow path is provided with an intake port for sucking in air toward the compressor impeller, a diffuser passage through which compressed air discharged from the compressor impeller passes through, and a discharge scroll chamber into which the compressed air passing through the diffuser passage flows. The discharge scroll chamber discharges the compressed air into the internal combustion engine side.

The internal combustion engine of an automobile or the like is, in some cases, provided with a positive crankcase ventilation system (hereinafter referred to as PCV) for purifying the inside of a crankcase and/or a head cover by reflowing blowby gas (mainly composed of unburned gas) that has generated in the crankcase. In this case, oil (oil mist) contained in the blowby gas may flow out from the PCV into an intake passage that is positioned upstream of the compressor in the turbocharger under some circumstances.

At that time, if air pressure at an outlet port of the compressor is high, air temperature at the outlet port of the compressor is made high, so that the oil flowing out from the PCV is concentrated and thickened by evaporation to have high viscosity. In some cases, the oil is accumulated as deposit on, for example, a diffuser surface of the housing for a turbocharger and/or the surface of a bearing housing which opposes the diffuser surface. And, there is a risk that the accumulated deposit may narrow the diffuser passage to thereby cause reduction in performance of the turbocharger and reduction in output of the internal combustion engine.

In the conventional technique to prevent such deposit accumulation in the diffuser passage as described above, the air temperature at the outlet port of the compressor was controlled to some extent. As a result, a turbocharger was not able to satisfactorily exhibit its performance, and the output of an internal combustion engine was not satisfactorily raised.

Patent Document 1 discloses a configuration to prevent deposit accumulation in a diffuser passage, in which a refrigerant flow path is provided inside of a housing for a turbocharger to allow a refrigerant to pass therethrough, thereby inhibiting an increase in the temperature of compressed air passing through an air flow path inside of the housing. In the configuration disclosed in Patent Document 1, the housing for a turbocharger is composed of a first piece, a second piece and a third piece, and these components are assembled to each other to define the refrigerant flow path.

PRIOR ART LITERATURE

Patent Document

Patent Document 1
JP-A-2016-176353

SUMMARY OF THE INVENTION

In the configuration disclosed in Patent Document 1, however, it is necessary to form a holding portion for holding an O-ring serving as a sealing member between the first piece and the second piece and to fit the sealing member into the holding portion, and in addition, to hold the sealing member by the first piece and the second piece. Thus, parts count is indispensably increased, which causes increase in manufacturing cost and reduction in assembling workability.

Further, in the configuration disclosed in Patent Document 1, each piece is formed in a shape having no undercut, employing dies-cutting which enables each piece to be molded by die casting. Because the cross-sectional shape of the scroll chamber largely differs from a circle accordingly, reduction in compression efficiency of supplied air is caused.

As a method to form the refrigerant flow path in the housing for a turbocharger, it is conceivable to use gravity casting with a sand core. According to this method, high flexibility in shape can be expected to thereby meet complicated shapes. On the other hand, this method requires long casting cycle, and the method needs a sand shakeout operation for removing the sand core and an inspection work for checking remaining casting sand. Therefore, the number of manufacturing processes is increased, and the productivity is reduced accordingly. In addition, there is a risk that the refrigerant flow path may communicate with outside due to a cavity defect and may have a leak of the refrigerant to the outside.

The present invention has been made in view of this background to provide a housing for a turbocharger, which makes it possible to prevent sticking of deposit and attain satisfactory assembling workability and easy moldability by die casting.

One aspect of the present invention provides a housing for a turbocharger which houses a compressor impeller, the housing including:

an intake port formation part that defines an intake port configured to suck in air toward the compressor impeller;

a shroud part that surrounds the compressor impeller in a circumferential direction and has a shroud surface facing the compressor impeller;

a diffuser part that is formed on an outer circumferential side of the compressor impeller in the circumferential direction and forms a diffuser passage configured to allow compressed air discharged from the compressor impeller to pass therethrough;

a scroll chamber formation part that forms a scroll chamber configured to guide the compressed air passing through the diffuser passage to outside; and a refrigerant flow path that is formed along the diffuser part in the circumferential direction, and allows a refrigerant for cooling the diffuser part to pass therethrough, wherein the housing is dividably composed of a scroll piece including part of the scroll chamber formation part, and a shroud piece including at least part of the intake port formation part, part of the scroll chamber formation part, the diffuser part, and the shroud part and being press-fitted into an inner side of the scroll piece in a shaft direction, wherein the refrigerant flow path is formed as an annular space that is defined by a first flow-path formation part of the scroll piece and a second flow-path formation part of the shroud piece, the first flow-path formation part and the second flow-path formation part being formed respectively at each opposing part of the scroll piece and the shroud piece which oppose each other, wherein the first flow path formation part and the second flow path formation part are fitted with each other at an inner circumferential seal part configured to seal the refrigerant flow path on the inner circumferential side of the refrigerant flow path and at an outer circumferential seal part configured to seal the refrigerant flow path on the outer circumferential side of the refrigerant flow path, wherein the inner circumferential seal part is formed by press-fitting a first press-fitting portion of the shroud piece into a first press-fitted portion of the scroll piece, and wherein the outer circumferential seal part is formed by press-fitting a second press-fitting portion of the shroud piece into a second press-fitted portion of the scroll piece.

According to the aforementioned one aspect, the housing for a turbocharger is dividably formed, and the refrigerant flow path is defined by the first flow-path formation part and the second flow-path formation part. The first flow-path formation part and the second flow-path formation part are formed respectively at each opposing part of the scroll piece and the shroud piece which oppose each other. The refrigerant flow path is sealed at an inner circumferential seal part on the inner circumferential side of the refrigerant flow path and at an outer circumferential seal part on the outer circumferential side of the refrigerant flow path. The inner circumferential seal part is formed by press-fitting the first press-fitting portion of the shroud piece into the first press-fitted portion of the scroll piece, and the outer circumferential seal part is formed by press-fitting the second press-fitting portion of the shroud piece into a second press-fitted portion of the scroll piece. Such a configuration makes it possible to seal the refrigerant flow path on the inner circumferential side of the refrigerant flow path and on the outer circumferential side of the refrigerant flow path only by press-fitting the shroud piece into the scroll piece to assemble the both. Consequently, it becomes unnecessary to interpose an O-ring between the first flow path formation part and the second flow path formation part, and the assembling workability is made satisfactory. Further, because the O-ring itself is not necessary, reduction of the parts count can be achieved.

Further, the housing for a turbocharger is dividedly formed and includes the scroll piece and the shroud piece. The scroll chamber is formed by assembling at least both pieces to each other. Thus, the scroll chamber can be formed to have a circular cross section, and the scroll chamber formation part can be formed into a shape having no undercut, which can be formed by die-cutting. As a result, the scroll chamber can be more easily formed by die casting, and the compression efficiency for the supplied air can be improved.

DETAILED DESCRIPTION OF THE INVENTION

Figure 1:
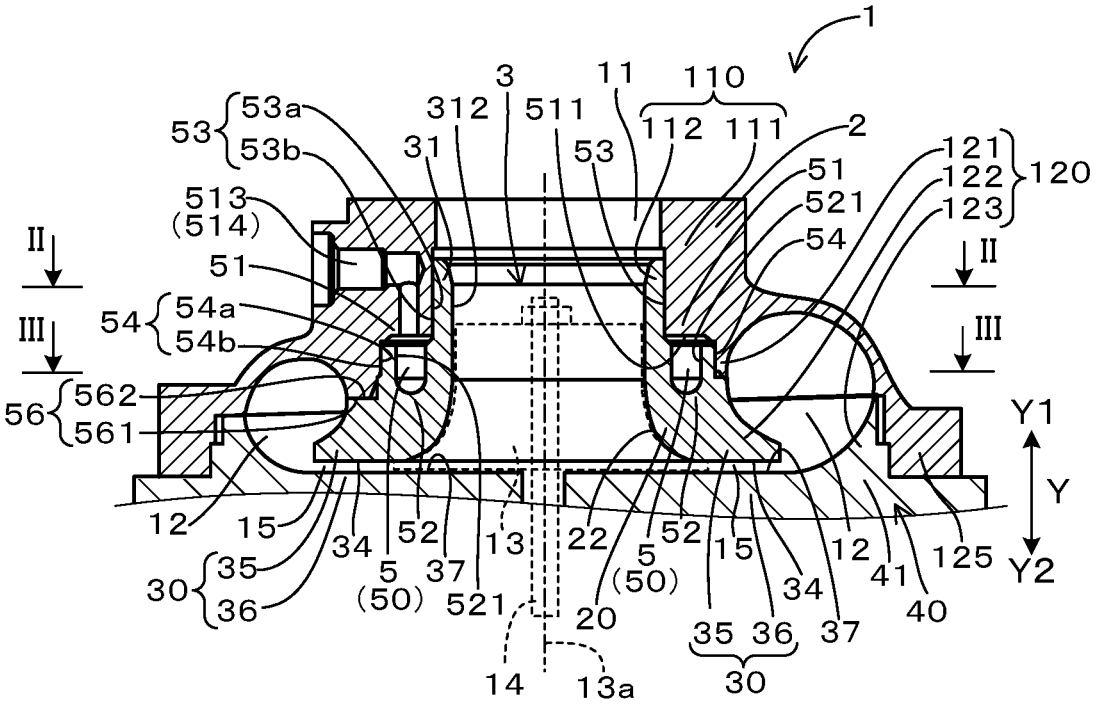
FIG. 1 is a cross-sectional view of a housing for a turbocharger according to Embodiment 1.

"Circumferential direction" in the present specification means the rotation direction of a compressor impeller, "shaft direction" means the direction of the rotation shaft of the compressor impeller, "radial direction" means the radius direction of an imaginary circle centered on the rotation shaft of the compressor impeller, and "outwardly in the radial direction" is defined to be in the direction straightly extending from the center of the imaginary circle to the circumference of the circle.

The first press-fitting portion preferably includes at least part of the intake port formation part, and the first press-fitted portion is preferably formed as an intake side press-fitted portion configured to have at least part of the intake port formation part press-fitted thereinto, and the second press-fitted portion preferably includes part of the scroll chamber formation part, and the second press-fitting portion is preferably formed as a scroll chamber side press-fitting portion configured to be press-fitted into the part of the scroll chamber formation part. Such a configuration makes it possible to impart a function of the inner circumferential seal part to the intake port formation part and to impart a function of the outer circumferential seal part to the scroll chamber formation part, so that the structure of the shroud piece can be simplified.

The scroll piece preferably includes a refrigerant feed part formed of a penetration hole that communicates with the refrigerant flow path to feed the refrigerant to the refrigerant flow path, and a refrigerant discharging part formed of a penetration hole that communicates with the refrigerant flow path to discharge the refrigerant from the refrigerant flow path Such a configuration makes it possible to easily form the refrigerant feed part and the refrigerant discharging part and to surely flow the refrigerant through the refrigerant flow path.

At least one of the inner circumferential seal part and the outer circumferential seal part is preferably provided with a sealing material between the scroll piece and the shroud piece to seal a gap between the scroll piece and the shroud piece. Such a configuration makes it possible to enhance sealability at at least one of the inner circumferential seal part and the outer circumferential seal part thereby improving the reliability.

The scroll piece and the shroud piece preferably have in common a contact portion configured to perform positioning at press-fitting by contacting the scroll piece and the shroud piece in a state of opposing in a shaft direction. In such a configuration, the contact portion performs positioning of the scroll piece and the shroud piece in the shaft direction serving as a press-fitting direction, thereby improving the assembling precision of the scroll piece and the shroud piece.

Another aspect of the present invention provides a method for manufacturing the housing for a turbocharger, the method including the steps of:

molding the scroll piece and the shroud piece by die-casting; and assembling the shroud piece to the scroll piece, while forming the refrigerant flow path by forming the inner circumferential seal part and the outer circumferential seal part, the inner circumferential seal part being formed by press-fitting the first press-fitting portion into the first press-fitted portion, and the outer circumferential seal part being formed by press-fitting the second press-fitting portion into the second press-fitted portion.

In this case, it is possible to form the refrigerant flow path by press-fitting the shroud piece into the scroll piece molded by die-casting to assemble the both while forming the inner circumferential seal part and the outer circumferential seal part. Thus, the refrigerant flow path can be sealed on the inner circumferential side of the refrigerant flow path and on the outer circumferential side of the refrigerant flow path only by press-fitting the shroud piece into the scroll piece to assemble the both. Consequently, it becomes unnecessary to interpose an O-ring between the first flow path formation part and the second flow path formation part, and the assembling workability is made satisfactory. Further, because the O-ring itself is not necessary, reduction of the parts count can be achieved.

It is preferable to perform the step of cutting the second flow-path formation part of the shroud piece after the molding step and prior to the assembling step thereby recessing the second flow-path formation part, or during the molding step and prior to the assembling step thereby further recessing the second flow-path formation part already recessively molded. In this case, when the second flow-path formation part is molded in a recessed shape in die-casting in the molding step, the diffuser part is required to have a certain thickness. However, the thickness of the diffuser part can be made thinner by recessively cutting the second flow-path formation part after the molding step, so that the refrigerant flow path can be formed at a position close to a diffuser surface. Consequently, it is possible to improve the cooling effect of the diffuser surface and prevent deposit accumulation more effectively.

EMBODIMENTS

Embodiment 1

Hereinafter, an embodiment of the aforementioned housing for a turbocharger will be described with reference to FIGS. 1 to 9.

As shown in FIG. 1, a housing 1 for a turbocharger houses a compressor impeller 13, and is provided with an intake port formation part 110, a shroud part 20, a diffuser part 30, a scroll chamber formation part 120 and a refrigerant flow path 5.

The intake port formation part 110 forms an intake port 11 configured to suck in air toward the compressor impeller 13.

The shroud part 20 surrounds the compressor impeller 13 in the circumferential direction and has a shroud surface 22 facing the compressor impeller 13.

The diffuser part 30 is formed on the outer peripheral side of the compressor impeller 13 in the circumferential direction and forms a diffuser passage 15 that allows compressed air discharged from the compressor impeller 13 to pass therethrough.

The scroll chamber formation part 120 forms a scroll chamber 12 for guiding the compressed air passing through the diffuser passage 15 to the outside.

The refrigerant flow path 5 is formed along the diffuser part 30 in the circumferential direction, and allows a refrigerant for cooling the diffuser part 30 to pass therethrough.

The housing 1 is dividably composed of a scroll piece 2 including at least part of the scroll chamber formation part 120, and a shroud piece 3 including at least part of the intake port formation part 110, part of the scroll chamber formation part 120, the diffuser part 30, and the shroud part 20 and being inserted in the inner side of the scroll piece 2.

Figure 3:
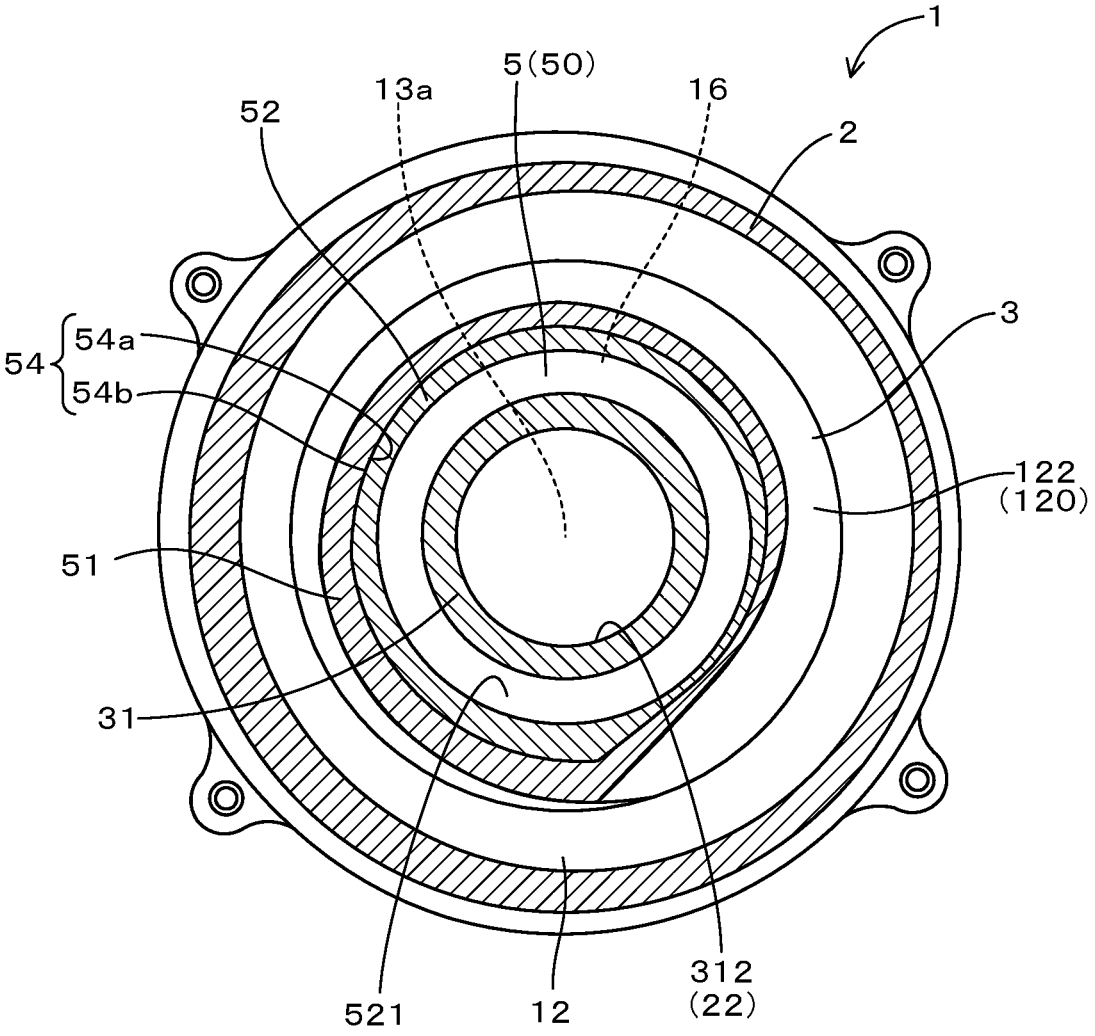
FIG. 3 is a sectional view taken along arrows in FIG. 1.

As shown in FIGS. 1 and 3, the refrigerant flow path 5 is formed as an annular space that is defined by a first flow-path formation part 51 of the scroll piece 2 and a second flow-path formation part 52 of the shroud piece 3, the first flow-path formation part 51 and the second flow-path formation part 52 being formed respectively at each opposing position of the scroll piece and the shroud piece which oppose each other.

The first flow path formation part 51 and the second flow path formation part 52 are fitted with each other at an inner circumferential seal part 53 configured to seal the refrigerant flow path 5 on the inner circumferential side of the refrigerant flow path 5 and at an outer circumferential seal part configured to seal the refrigerant flow path 5 on the outer circumferential side of the refrigerant flow path 5.

The inner circumferential seal part 53 is formed by press-fitting a first press-fitting portion 53*b* of the shroud piece 3 into a first press-fitted portion 53*a* of the scroll piece 2.

The outer circumferential seal part 54 is formed by press-fitting a second press-fitting portion 54*b* of the shroud piece 3 into a second press-fitting portion 54*b* of the scroll piece 2.

Hereinafter, the housing 1 for a turbocharger according to the present embodiment will be described in detail.

As shown in FIG. 1, the housing 1 for a turbocharger is formed dividably, including the scroll piece 2 and the shroud piece 3 each formed separately. The housing 1 is attached to a seal plate 40 of a bearing housing (not shown in any figure) that houses a bearing unit for bearing a shaft 14 on one end of which the compressor impeller 13 is attached.

Figure 7:
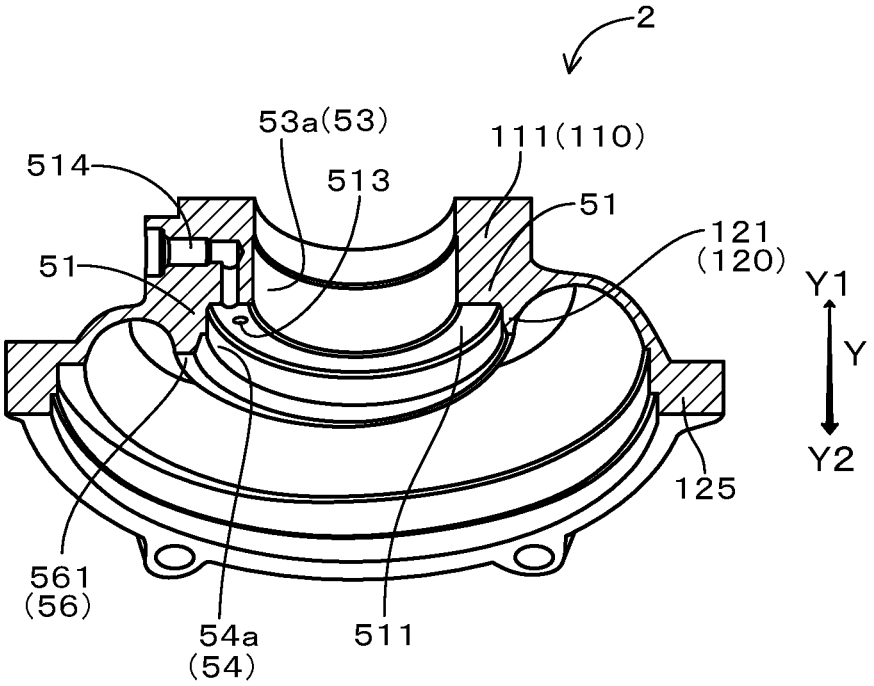
FIG. 7 is a cross-sectional perspective view of a scroll piece according to Embodiment 1.

The scroll piece 2, as shown in FIGS. 1 and 7, includes a first intake port formation part 111, a first scroll chamber formation part 121, an outer peripheral portion 125, and a first flow-path formation part 51. The first intake port formation part 111 constitutes the intake port formation part 110 with a second intake port formation part 112 described later, and has a cylindrical shape penetratingly formed in the shaft direction Y. The first scroll chamber formation part 121 constitutes a wall surface of the scroll chamber 12 on an intake side Y1. As shown in FIG. 1, the outer peripheral portion 125 corresponds to a part of the first scroll chamber formation part 121 on a side Y2 opposite to the intake side Y1, and forms the outer peripheral portion of the housing 1 for a turbocharger. Inside of the outer peripheral portion 125 is attached the seal plate 40.

Figure 4:
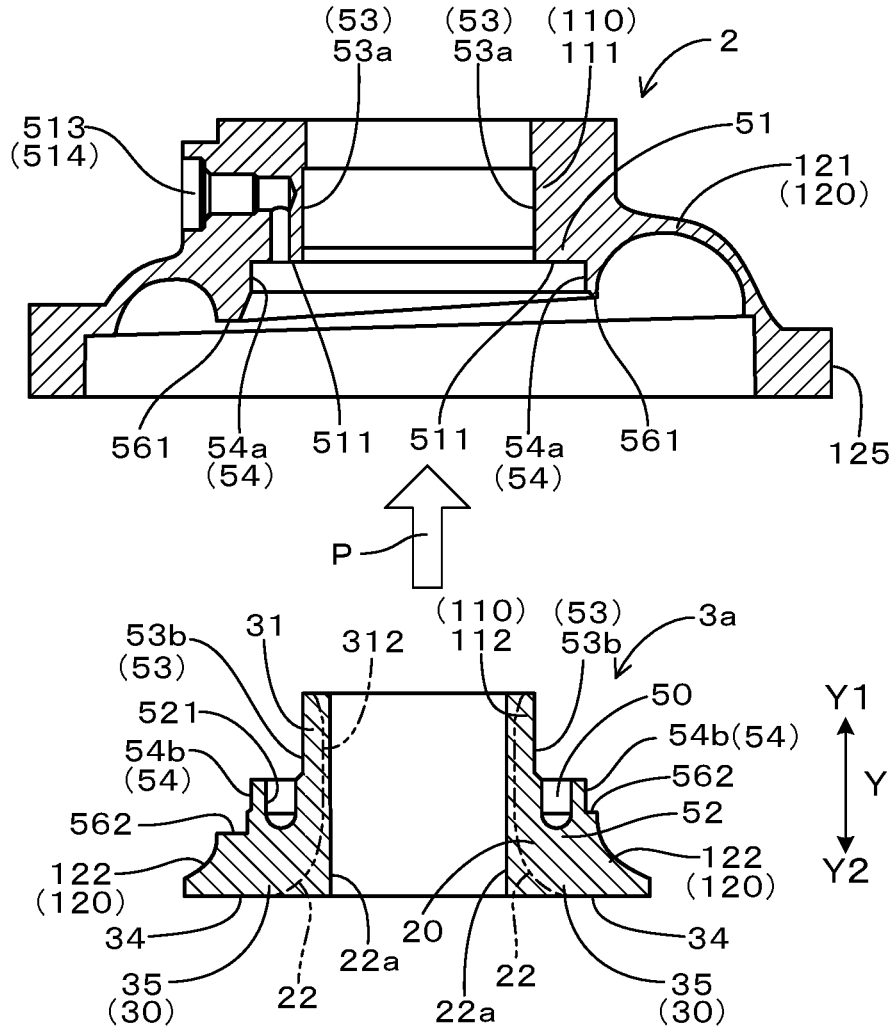
FIG. 4 is a schematic diagram for illustrating a method for manufacturing the housing for a turbocharger according to Embodiment 1.

As shown in FIG. 1, the first flow-path formation part 51 of the scroll piece 2 is configured to define the refrigerant flow path 5 with the second flow-path formation part 52 to be described later. The first flow-path formation part 51 is provided more forward on the Y2 side opposite to the intake side Y1 than the first intake port formation part 111. As shown in FIGS. 4 and 7, the first flow-path formation part 51 has a first wall surface 511 corresponding to the wall surface of the refrigerant flow path 5 on the intake side Y1. In the present embodiment, the first wall surface 511 has a surface parallel to the radial direction. Note that the first wall surface 511 may not be necessarily flat, may be recessed toward the intake side Y1.

Figure 2:
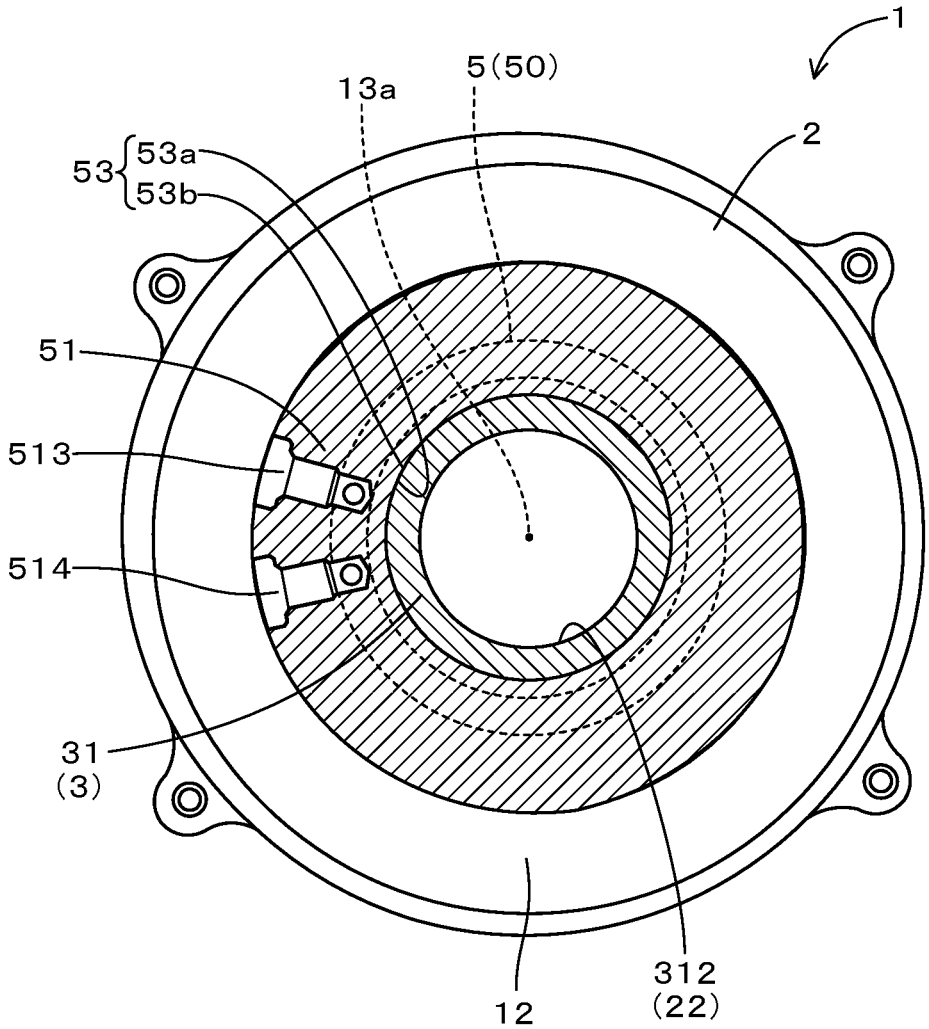
FIG. 2 is a sectional view taken along arrows II-II in FIG. 1.

As shown in FIG. 1, the second intake port formation part 112 of the shroud piece 3 to be described later is press-fitted into the inner circumference of the first intake port formation part 111 of the scroll piece 2. Thus, the first press-fitting portion 53*b*, i.e. an outer circumference part of the second intake port formation part 112 is press-fitted into the first press-fitted part 53*a*, i.e. an inner circumference part of the first intake port formation part 111 to form the inner circumferential seal part 53. As shown in FIG. 2, the first press-fitted part 53*a* and the first press-fitting portion 53*b* abut on each other throughout the entire circumference.

As shown in FIG. 1, an outer circumference part of the second flow-path formation part 52 of the shroud piece 3 to be described later is press-fitted into the inner circumference of the first scroll chamber formation part 121 of the scroll piece 2. In fact, the second press-fitting portion 54*b* as an outer circumference part of the second flow-path formation part 52 is press-fitted into the second press-fitted portion 54*a* as an inner circumference part of the first scroll chamber formation part 121 to form the outer circumferential seal part 54. As shown in FIG. 3, the second press-fitted part 54*a* and the second press-fitting portion 54*b* abut on each other throughout the entire circumference. An interference of the inner circumferential seal part 53 and the outer circumferential seal part 54 is not specifically limited, and can be determined as appropriate considering the stress generated at the inner circumferential seal part 53 and the outer circumferential seal part 54. In the present embodiment, the interference of the both is set to the same magnitude.

As shown in FIGS. 1 and 2, the scroll piece 2 includes a refrigerant feed part 513 and a refrigerant discharging part 514 formed of a penetration hole that penetrates the first flow-path formation part 51 and communicates with the refrigerant flow path 5. The refrigerant feed part 513 is configured to feed the refrigerant to the refrigerant flow path 5. The refrigerant discharging part 514 is configured to discharge the refrigerant from the refrigerant flow path 5. In the present embodiment, as shown in FIG. 1, the refrigerant feed part 513 and the refrigerant discharging part 514 are composed of a horizontal hole that is formed in the radial direction from the outer circumference of the scroll piece 2, and a vertical hole that is formed in a direction parallel to the shaft direction Y from the first wall surface 511 so as to communicate with the horizontal hole.

Figure 6:
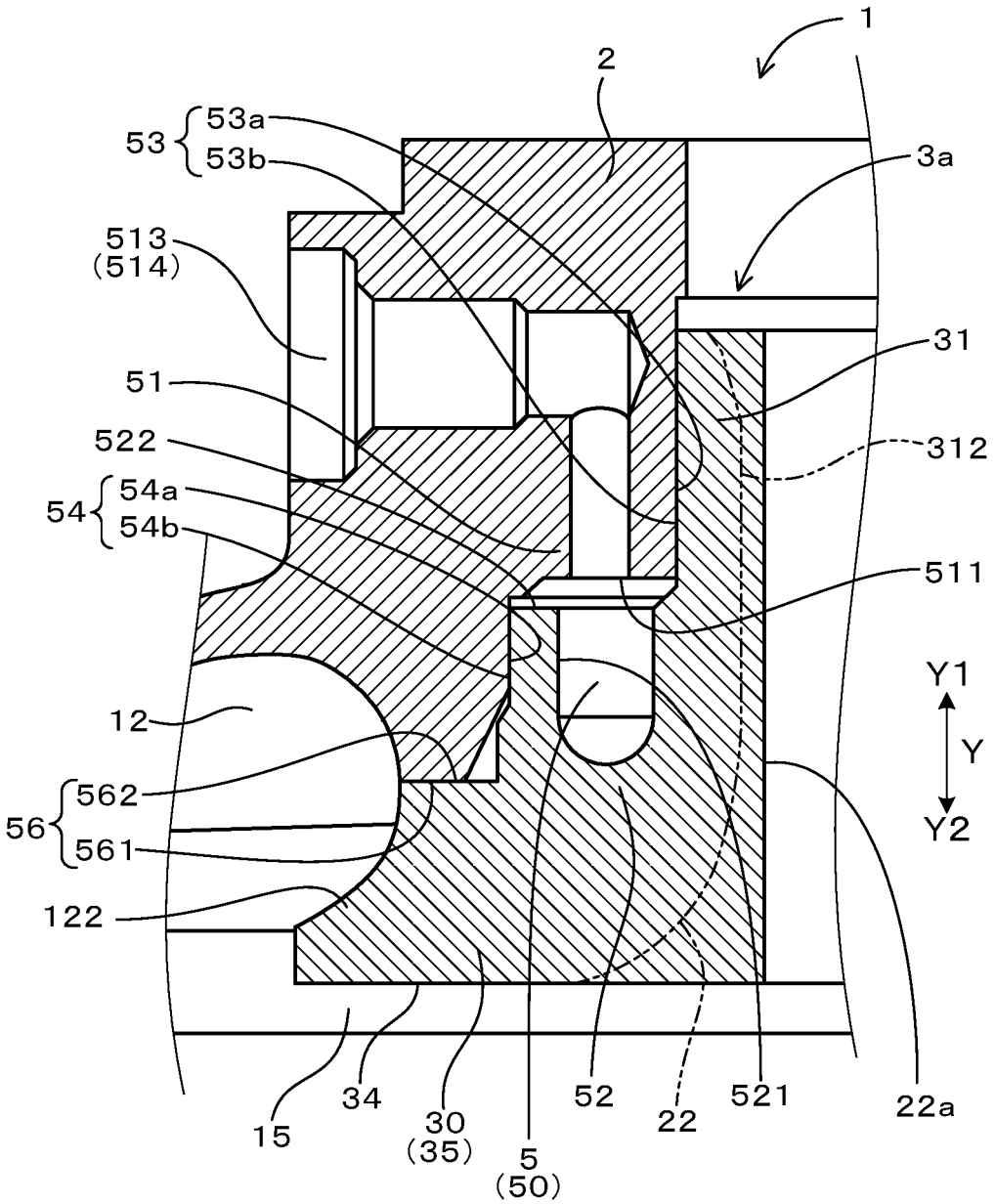
FIG. 6 is an enlarged cross-sectional view of the housing for a turbocharger according to Embodiment 1.

As shown in FIGS. 1 and 7, the scroll piece 2 has a first contact surface 561 forming a wall surface parallel to the radial direction, outside of the outer circumferential seal part 54 in the radial direction and inside of the scroll chamber 12. As shown in FIG. 6, the first contact surface 561 abuts on a second contact surface 562 of the shroud piece 3 which will be described later. Thus, a third facing surface 522 that faces the first wall surface 511 of the first flow-path formation part 51 has no contact with the third facing surface 522.

Figure 8:
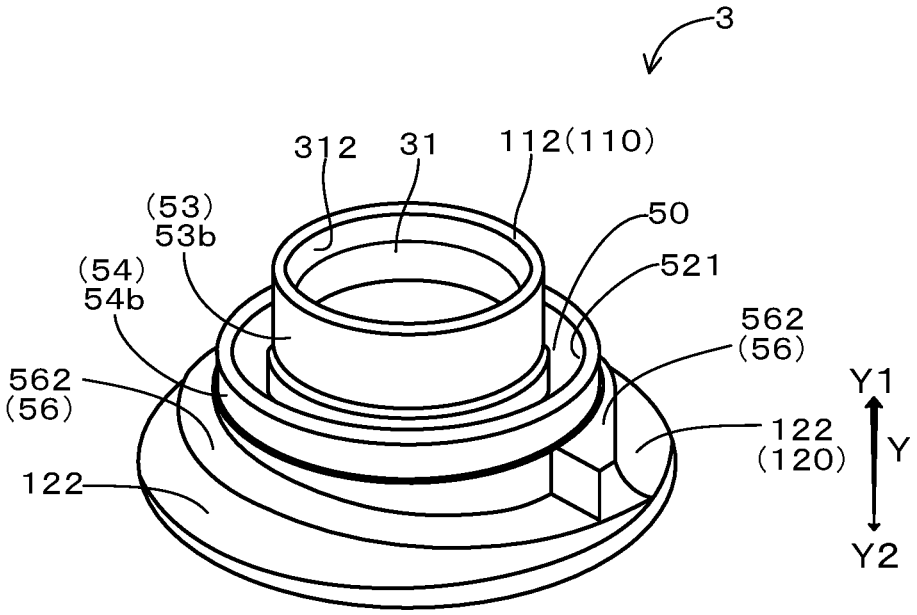
FIG. 8 is a perspective view of a shroud piece according to Embodiment 1.
Figure 9:
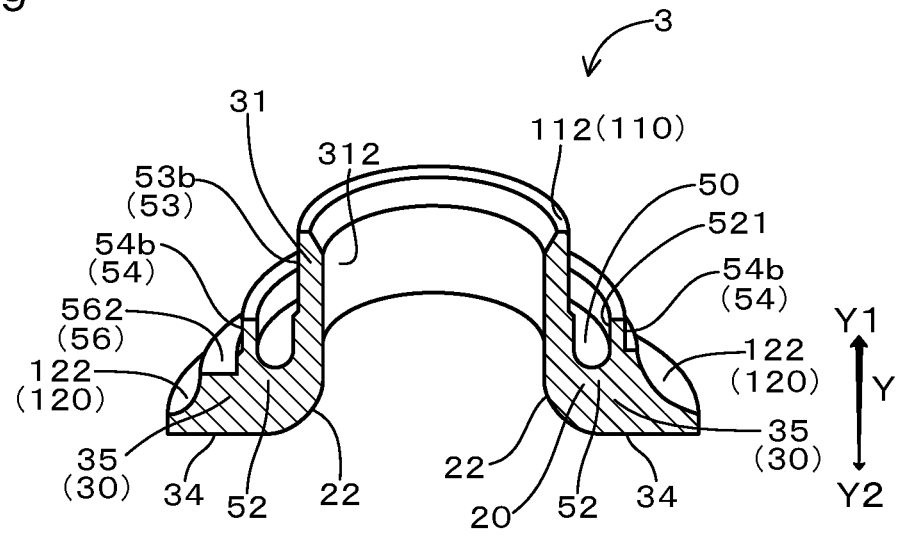
FIG. 9 is a cross-sectional perspective view of a shroud piece according to Embodiment 1.

The shroud piece 3, as shown in FIGS. 1, 8, and 9, includes a shroud press-fit portion 31, a second scroll chamber formation part 122, the shroud part 20, a first diffuser part 35, and the second flow-path formation part 52. The shroud press-fit portion 31 is formed in a cylindrical shape, and an end part of the shroud press-fit portion 31 on the intake side Y1 constitutes the second intake port formation part 112 that forms part of the intake port 11. As shown in FIG. 4, the inner circumferential seal part 53 is formed by press-fitting the shroud press-fit portion 31 and the second intake port formation part 112 into the inside of the first intake port formation part 111, as described above.

As shown in FIG. 1, the second scroll chamber formation part 122 forms a wall surface of the scroll chamber 12 on its inner circumferential side. The shroud part 20 forms the shroud surface 22 facing the compressor impeller 13. A first diffuser part 35 forms a diffuser surface 34 that extends from the shroud surface 22 toward the scroll chamber 12.

As shown in FIG. 1, the second flow-path formation part 52 is configured to form the refrigerant flow path 5 with the aforementioned first flow-path formation part 51, and is formed on the intake side Y1 of the first diffuser part 35. As shown in FIGS. 3, 4, 8, and 9, the second flow-path formation part 52 includes a second wall surface 521 recessively formed toward the Y2 side opposite to the intake side Y1. In the present embodiment, the second wall surface 521 is recessively formed in a U-shape in the cross section parallel to the shaft direction Y, and at the same time, the second wall surface 521 forms an annular recess extending in the circumferential direction radially outside of the shroud surface 22 as shown in FIGS. 3 and 9. As shown in FIGS. 1 and 9, the second flow-path formation part 52 has the second contact surface 562 that forms a wall surface parallel to the radial direction, radially outside of the second wall surface 521. As shown in FIG. 1, the second contact surface 562 is in contact with the first contact surface 561 of the scroll piece 2 as mentioned above.

As shown in FIG. 1, the first press-fitting portion 53*b* as an outer circumference part of the shroud press-fit portion 31 and the first press-fitted portion 53*a* as an inner circumference part of the first intake port formation part 111 are bought in contact with each other with no space therebetween by press-fitting the shroud press-fit portion 31 into the inside of the first intake port formation part 111, and at the same time, the second contact surface 562 is made abut on the first contact surface 561. In this way, the first contact surface 561 and the second contact surface 562 are in contact with each other to form the contact portion 56, and to form the refrigerant flow path 5 as an annular space 50 between the first flow-path formation part 51 and the second flow-path formation part 52.

At least one of the inner circumferential seal part 53 and the outer circumferential seal part 54 may be provided with a sealing material. Although the kinds of the sealing material are not specifically limited, quickly dryable ones are preferable. For example, sealing materials to be used as a liquid gasket can be used.

A seal plate 40, as shown in FIG. 1, includes a third scroll chamber formation part 123, a seal plate insertion portion 41, and a second diffuser part 36. The third scroll chamber formation part 123 forms a wall surface of the scroll chamber 12 on its outer circumference side. The seal plate insertion portion 41 is inserted into the inside of the outer circumferential portion 125. The second diffuser part 36 forms the diffuser part 30 with the first diffuser part 35. The second diffuser part 36 has a facing surface 37 that faces the diffuser surface 34 of the first diffuser part 35 spaced at a predetermined distance. The space formed between the diffuser surface 34 and the facing surface 37 defines the diffuser passage 15.

Next, a method for manufacturing the housing 1 for a turbocharger according to the present embodiment will be described.

The method for manufacturing the housing 1 for a turbocharger includes a molding step S1, and an assembling step S2. Firstly in the molding step S1, the scroll piece 2 and the shroud piece 3 are separately prepared by die casting, as shown in FIG. 4. As shown in FIG. 4, in preparation of the shroud piece 3, a shroud piece precursor 3*a* serving as a raw material for the shroud piece 3 is firstly molded by die casting. In the shroud piece precursor 3*a*, a shroud surface 22 and an inside surface 312 of the shroud press-fit portion 31 have not been formed, and an inside surface 22*a* of the shroud piece precursor 3*a* is cylindrical. Except for this, the shroud piece precursor 3*a* has an outer shape equivalent to that of the shroud piece 3.

Figure 5:
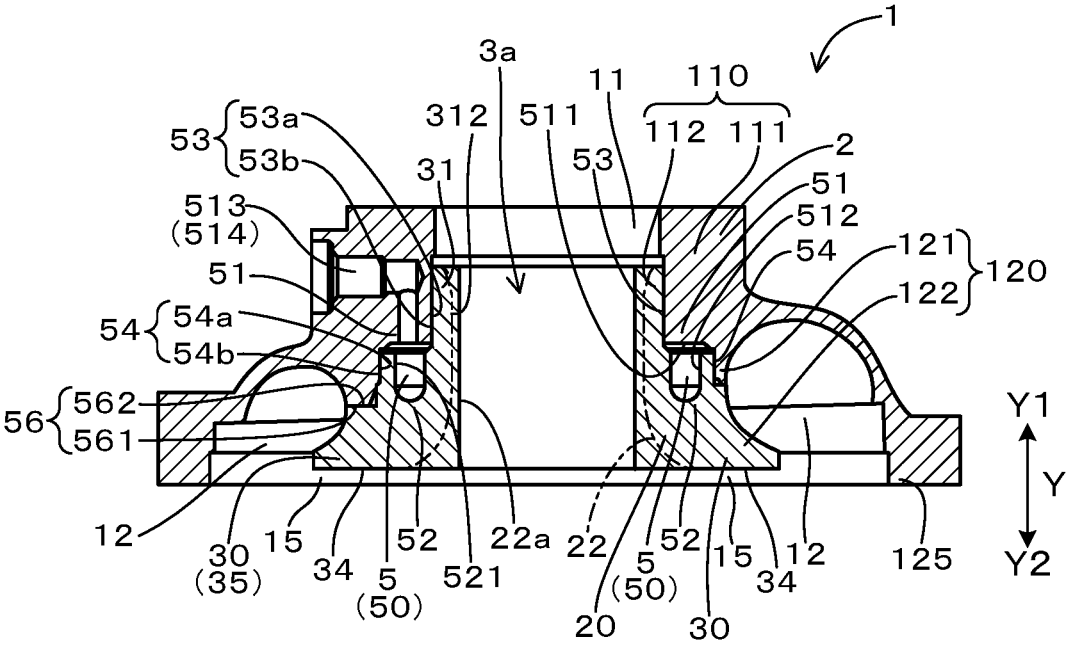
FIG. 5 is another schematic diagram for illustrating the method for manufacturing the housing for a turbocharger according to Embodiment 1.

Next in the assembling step S2, the shroud press-fit portion 31 of the shroud piece precursor 3*a* is press-fitted into the inside of the intake port formation part 111 of the scroll piece 2 in the direction as shown by an arrow P in FIG. 4, and the second contact surface 562 of the shroud piece precursor 3*a* is made abut on the first contact surface 561 of the scroll piece 2 as shown in FIG. 5. In this way, the refrigerant flow path 5 is formed between the first flow-path formation part 51 and the second flow-path formation part 52 as the annular space 50.

By press-fitting the shroud piece precursor 3*a* into the scroll piece 2, the first press-fitting portion 53*b* as the outer circumference part of the second intake port formation part 112 is press-fitted into the first press-fitted portion 53*a* as the inner circumference part of the first intake port formation part 111 to form the inner circumferential seal part 53, and at the same time the second press-fitting portion 54*b* as the outer circumference part of the second flow-path formation part 52 is press-fitted into the second press-fitted portion 54*a* as the inner circumference part of the first scroll chamber formation part 121 to form the outer circumferential seal part 54. In this way, the refrigerant flow path 5 is sealed between the first flow-path formation part 51 and the second flow-path formation part 52.

Then, the shroud piece precursor 3*a* is subjected to lathe machining to have the shroud surface 22 formed thereon. In the lathe machining, an assembly composed of the scroll piece 2 and the shroud piece precursor 3*a* is rotated around a shaft center 13*a* of the compressor impeller 3 to cut the inside surface 22*a* of the shroud piece precursor 3*a* with a jig and form the shroud surface 22. Thus, the housing 1 for a turbocharger is produced.

In the housing 1 for a turbocharger, a refrigerant introduction tube and a refrigerant discharge tube, which are not shown in any figure, are connected respectively to the refrigerant feed part 513 and the refrigerant discharging part 514 each communicated with the refrigerant flow path 5 as shown in FIGS. 1 and 2. The diffuser surface 34 can be cooled by circulating the refrigerant in the refrigerant flow path 5 via these tubes.

Further in the present embodiment, the sealing material may be provided at the inner circumferential seal part 53 by applying the sealing material to the first press-fitted portion 53*a* or the first press-fitting portion 53*b* after the molding step S1, and then performing the assembling step S2. Similarly, the sealing material may be provided at the outer circumferential seal part 54 by applying the sealing material to the second press-fitted portion 54*a* or the second press-fitting portion 54*b* after the molding step S1, and then performing the assembling step S2.

Hereinafter, operational effects of the housing 1 for a turbocharger according to the present embodiment will be described in detail.

According to the housing 1 for a turbocharger of the present embodiment, the housing 1 for a turbocharger is dividably formed, and the refrigerant flow path 5 is defined by the first flow-path formation part 51 of the scroll piece 2 and the second flow-path formation part 52 of the shroud piece 3, which are formed respectively at each opposing part of the scroll piece 2 and the shroud piece 3 which oppose each other. The inner circumferential seal part 53 and the outer circumferential seal part 54 seal the refrigerant flow path 5 respectively on the inner circumference side and on the outer circumference side. The inner circumferential seal part 53 is formed by press-fitting the first press-fitting portion 53*b* of the shroud piece 3 into the first press-fitted portion 53*a* of the scroll piece 2, and the outer circumferential seal part 54 is formed by press-fitting the second press-fitting portion 54*b* of the shroud piece 3 into the second press-fitted portion 54*a* of the scroll piece 2. Such a configuration makes it possible to seal the refrigerant flow path 5 on the inner circumferential side of the refrigerant flow path 5 and on the outer circumferential side of the refrigerant flow path 5 only by press-fitting the shroud piece 3 into the scroll piece 2 to assemble the both. Consequently, it becomes unnecessary to interpose an O-ring between the first flow path formation part 51 and the second flow path formation part 52, and the assembling workability is made satisfactory. Further, because the O-ring itself is not necessary, reduction of the parts count can be achieved.

Further, the housing 1 for a turbocharger is dividably formed including the scroll piece 2 and the shroud piece 3. The scroll chamber 12 is formed by assembling at least the both pieces. Thus, the scroll chamber 12 can be formed to have a circular cross section, and the scroll chamber formation part 120 can be formed into a shape having no undercut, which can be formed by die-cutting. As a result, the scroll chamber can be more easily formed by die casting, and the compression efficiency for the supplied air can be improved.

In addition, the refrigerant flow path 5 in the housing 1 for a turbocharger according to the present embodiment is easily applicable to a conventional turbocharger housing because it requires no significant change in the basic structure of a scroll piece and a shroud piece in the conventional turbocharger housing.

In the present embodiment, the first press-fitting portion 53*b* is formed of the second intake port formation part 112, i.e. part of the intake port formation part composed of the intake port formation parts 111 and 112, and the first press-fitted portion 53*a* is formed of the first intake port formation part 111 serving as an intake side press-fitting portion into which the second intake port formation part 112 is press-fitted. And the second press-fitted portion 54*a* is formed of the first scroll chamber formation part 121, i.e. part of the scroll chamber formation part 120, and the second press-fitting portion 54*b* is formed of an outer peripheral portion of the second flow-path formation part 52 serving as a scroll chamber side press-fitting portion which is press-fitted into the first scroll chamber formation part 121, i.e. part of the scroll chamber formation part 120. Such a configuration makes it possible to impart a function of the inner circumferential seal part 53 to the second intake port formation part 112 and to impart a function of the outer circumferential seal part 54 to the first scroll chamber formation part 121, and the structures of the scroll piece 2 and the shroud piece 3 can be simplified.

In the present embodiment, the scroll piece 2 includes the refrigerant feed part 513 formed of a penetration hole that communicates with the refrigerant flow path 5 to feed the refrigerant to the refrigerant flow path 5, and the refrigerant discharging part 514 formed of a penetration hole that communicates with the refrigerant flow path 5 to discharge the refrigerant from the refrigerant flow path 5. Such a configuration makes it possible to easily form the refrigerant feed part 513 and the refrigerant discharging part 514 and to surely flow the refrigerant through the refrigerant flow path 5.

In the present embodiment, at least one of the inner circumferential seal part 53 and the outer circumferential seal part 54 is provided with a sealing material between the scroll piece 2 and the shroud piece 3 to seal a gap between the scroll piece 2 and the shroud piece 3. Such a configuration makes it possible to enhance sealability at at the least one of the inner circumferential seal part 53 and the outer circumferential seal part 54 thereby preventing leakage of the refrigerant from the refrigerant flow path 5 to increase the reliability.

In the present embodiment, the scroll piece 2 and the shroud piece 3 have in common a contact portion 56 configured to perform positioning at press-fitting by contacting the scroll piece 2 and the shroud piece 3 in a state of opposing in a shaft direction Y. In such a configuration, the contact portion 56 performs positioning of the scroll piece 2 and the shroud piece 3 in the shaft direction Y serving as a press-fitting direction, thereby improving the assembling precision of the scroll piece 2 and the shroud piece 3.

The method for manufacturing the housing 1 for a turbocharger according to the present embodiment includes the molding step S1 of molding the scroll piece 2 and the shroud piece 3 by die-casting; and the assembling step S2 of assembling the shroud piece 2 to the scroll piece 3, while forming the refrigerant flow path 5 composed of the annular space 50 by forming the inner circumferential seal part 53 and the outer circumferential seal part 54. The inner circumferential seal part 53 is formed by press-fitting the first press-fitting portion 53*b* into the first press-fitted portion 53*a*, and the outer circumferential seal part 54 is formed by press-fitting the second press-fitting portion 54*b* into the second press-fitted portion 54*a*. Such a configuration makes it possible to seal the refrigerant flow path 5 on the inner circumferential side of the refrigerant flow path 5 and on the outer circumferential side of the refrigerant flow path 5 only by press-fitting the shroud piece 3 into the scroll piece 2 to assemble the both in the assembling step S2 after molding the scroll piece 2 and the shroud piece 3 by die-casting in the molding step S1. Consequently, it becomes unnecessary to interpose an O-ring between the first flow path formation part 51 and the second flow path formation part 52 in the assembling step S2, and the assembling workability is made satisfactory. Further, because the O-ring itself is not necessary, reduction of the parts count can be achieved.

Figure 10:
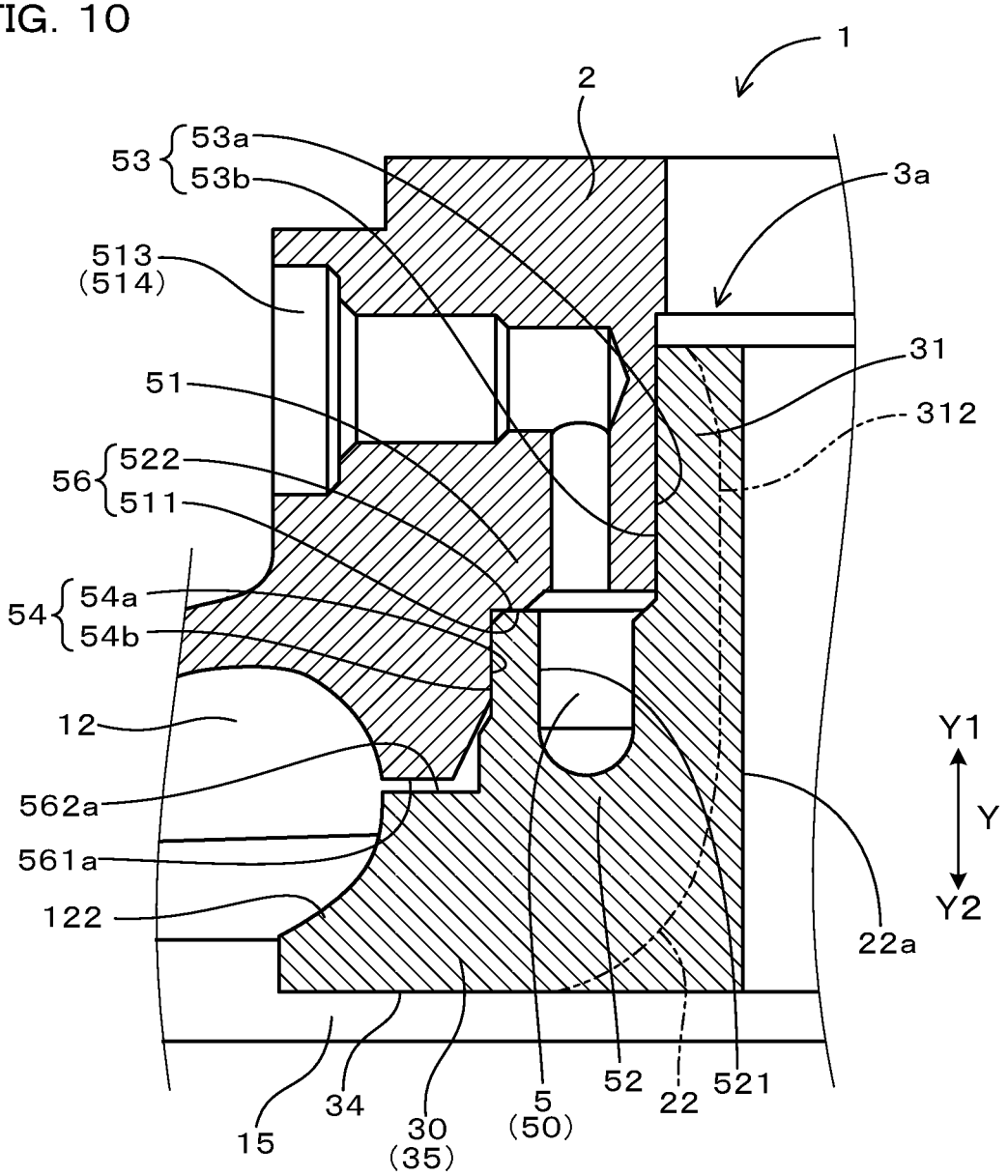
FIG. 10 is an enlarged cross-sectional view of a housing for a turbocharger according to Modification 1.

In the present embodiment, the contact portion 56 is formed by bringing a first contact surface 561 and a second contact surface 562, which are formed radially outside of the outer circumferential seal part 54, into contact with each other as shown in FIG. 6. Instead of this configuration, the contact portion 56 may be formed of a first wall surface 511 and a third facing surface 522 in the second flow-path formation part 52 by bringing the third facing surface 522 opposing the first wall surface 511 into contact with the first wall surface 511 as in Modification 1 shown in FIG. 10. In Modification 1, a first facing surface 561*a* and a second facing surface 562*b* respectively corresponding to the first contact surface 561 and the second contact surface 562 in Embodiment 1 are not in contact with each other. Also in Modification 1, positioning of the scroll piece 2 and the shroud piece 3 in the shaft direction Y serving as a press-fitting direction is performed by bringing the third facing surface 522 into contact with the first wall surface 511, so that the assembling precision of the scroll piece 2 and the shroud piece 3 can be improved, and the operational effects equivalent to those in Embodiment 1 are exhibited.

In the present embodiment, the housing 1 for a turbocharger is of a two-piece structure that is composed of the scroll piece 2 and the shroud piece 3. The housing 1 may be of a three-piece structure that is composed of the scroll piece 2, the shroud piece 3, and an outer circumference annular piece 4 as in Modification 2 shown in FIG. 11. The outer circumference annular piece 4 forms an annular shape, and includes a third scroll chamber formation part 123 and an outer circumference annular piece insertion portion 41. The outer circumference annular piece insertion portion 41 is press-fitted into the outer circumferential portion 125 to form a press-fit part 42. Note that components in Modification 2 equivalent to those in Embodiment 1 are allotted with the same reference numerals to simplify the description.

Figure 12:
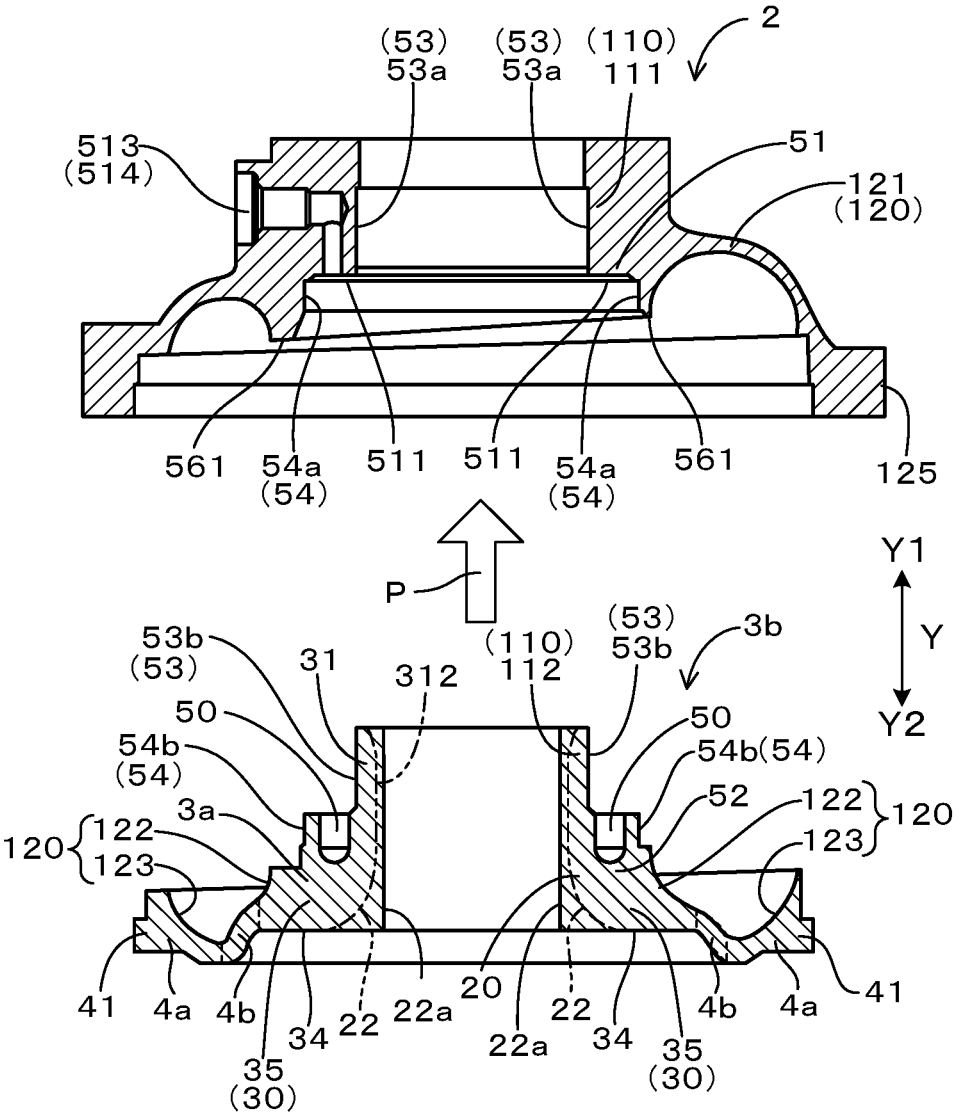
FIG. 12 is a schematic diagram for illustrating a method for manufacturing the housing for a turbocharger according to Modification 2.
Figure 13:
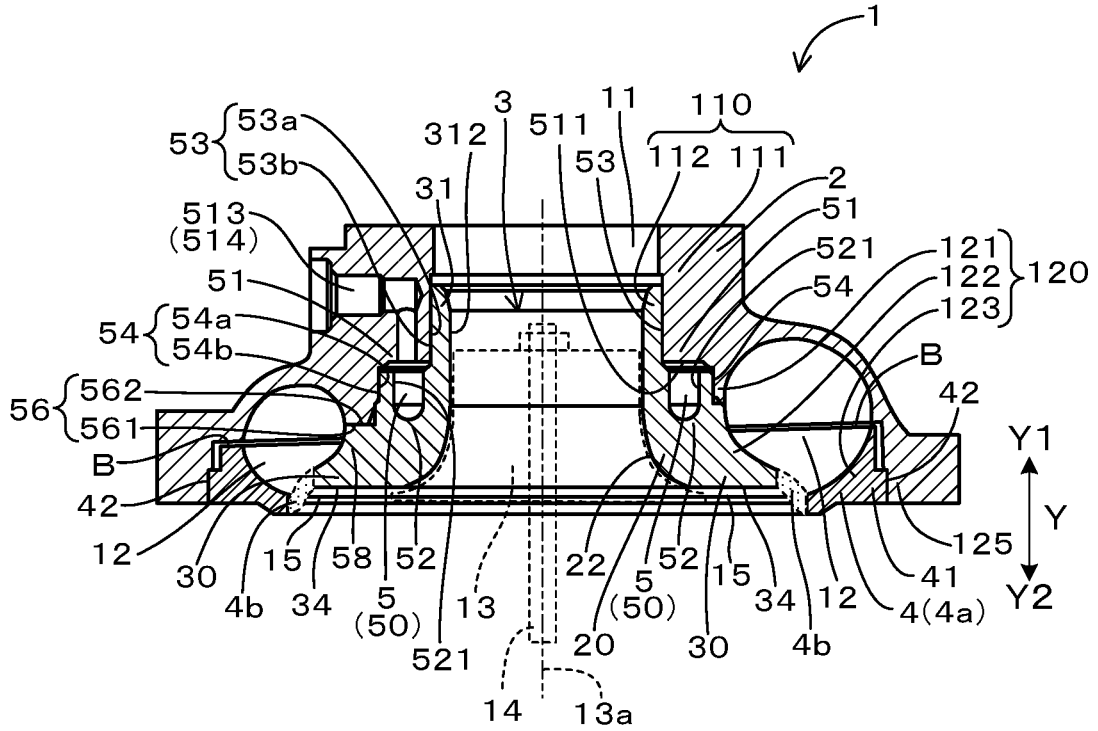
FIG. 13 is another schematic diagram for illustrating the method for manufacturing the housing for a turbocharger according to Modification 2.

Hereinafter, a method for manufacturing the housing 1 for a turbocharger according to Modification 2 will be described. Firstly, in the molding step S1, the scroll piece 2 is molded by die-casting in a similar way to that in Embodiment 1 as shown in FIG. 12. Then, an integral piece 3*b* is molded by die casting. The integral piece 3*b* is composed of the outer circumference part of the shroud piece precursor 3*a* in Embodiment 1 and the inner circumference part of an outer circumference annular piece precursor 4*a* with a contour of the outer circumference annular piece 4 both of which are integrated through a connecting portion 4*b*. Thereafter, in the assembling step S2, the integrated piece 3*b* is press-fitted into the inside of the scroll piece 2 in the direction indicated by the arrow P. Then, as shown in FIG. 13, the shroud piece 3 and the outer circumference annular piece 4 are separated from each other by cutting off the connecting portion 4*b* under the state in which the shroud piece 3 and the outer circumference annular piece 4 are press-fitted into the scroll piece 2. In this way, the housing 1 for a turbocharger according to Modification 2 is produced.

The housing 1 for a turbocharger according to Modification 2 also exhibits operational effects equivalent to those in Embodiment 1. An interference of the press-fit part 42 into which the outer circumference annular piece 4 is press-fitted is preferably smaller than that of the inner circumferential seal part 53 and the outer circumferential seal part 54. In this case, the integrated piece 3*b* can be easily press-fitted into the scroll piece 2. In addition, misalignment between the press-fit part of the shroud piece 3 (the inner circumferential seal part 53 and the outer circumferential seal part 54) and the press-fit part 42 of the outer circumference annular piece 4 can be absorbed.

Figure 11:
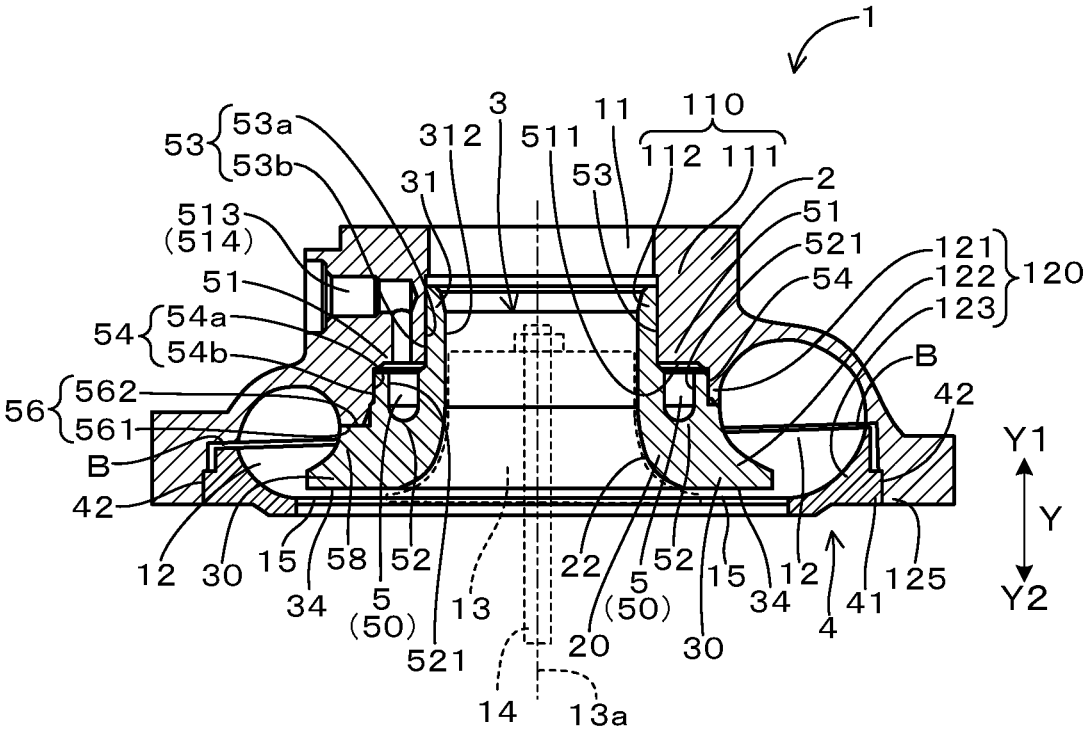
FIG. 11 is a cross-sectional view of a housing for a turbocharger according to Modification 2.

In the housing 1 for a turbocharger according to Modification 2, a part of the integrated piece 3*b* (the outer circumference annular piece precursor 4*a*) for constituting the outer circumference annular piece 4 is not brought into contact with the scroll piece 2 in the shaft direction in the assembling step S2 so as to form a gap B, as shown in FIGS. 11 and 13. Accordingly, it is possible to bring the first contact surface 561 into contact with the second contact surface 562 when the integrated piece 3*b* being press fitted. In this way, the integrated piece 3*b* can be positioned further accurately when being press-fitted in the shaft direction. In other words, the shroud piece 3 can be positioned further accurately in the shaft direction for completion. Note that it is also possible to accurately position the outer circumference annular piece 4 in the shaft direction by once again press-fitting the outer circumference annular piece 4 that has been separated from the integrated piece 3*b* after performing the assembling step S2 to the position so as to abut on the scroll piece 2 in the shaft direction.

In Embodiment 1, as shown in FIG. 1, the second intake port formation part 112 of the shroud piece 3 was positioned more forward on the Y2 side opposite to the intake side Y1 than the first intake port formation part 111 of the scroll piece 2. Instead of such a configuration, in Modification 3 shown in FIG. 14, the second intake port formation part 112 of the shroud piece 3 is positioned more forward on the Y1 side than the first intake port formation part 111 of the scroll piece 2. Note that components in Modification 3 equivalent to those in Embodiment 1 are allotted with the same reference numerals to simplify the description.

Figure 14:
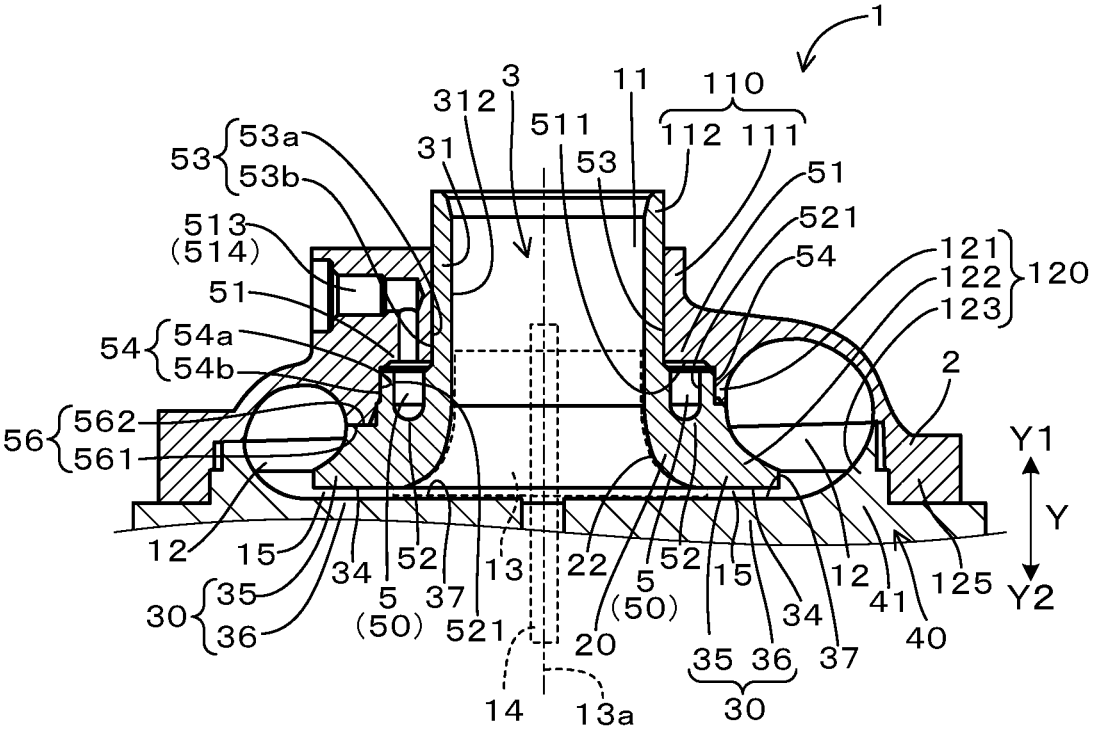
FIG. 14 is a cross-sectional view of a housing for a turbocharger according to Modification 3.

In the housing 1 for a turbocharger according to Modification 3, the second intake port formation part 112 is positioned more forward on the Y1 side than the first intake port formation part 111, as shown in FIG. 14, and thus an inner circumference surface of the intake port 11 is formed flush with an inside surface 312 of the shroud press-fit portion 31. Consequently, losses in flowing of the intake air can be inhibited to thereby improve the compression efficiency of charging air. Modification 3 also exhibits operational effects equivalent to those in Embodiment 1.

Embodiment 2

Figure 15:
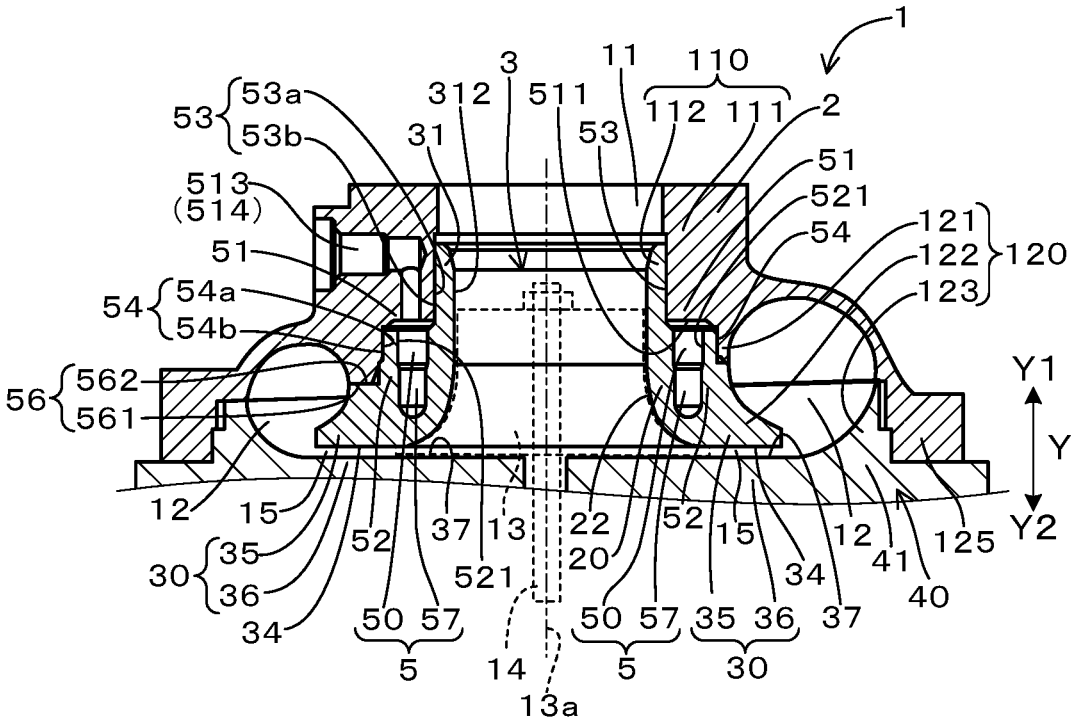
FIG. 15 is a cross-sectional view of a housing for a turbocharger according to Embodiment 2.
Figure 16:
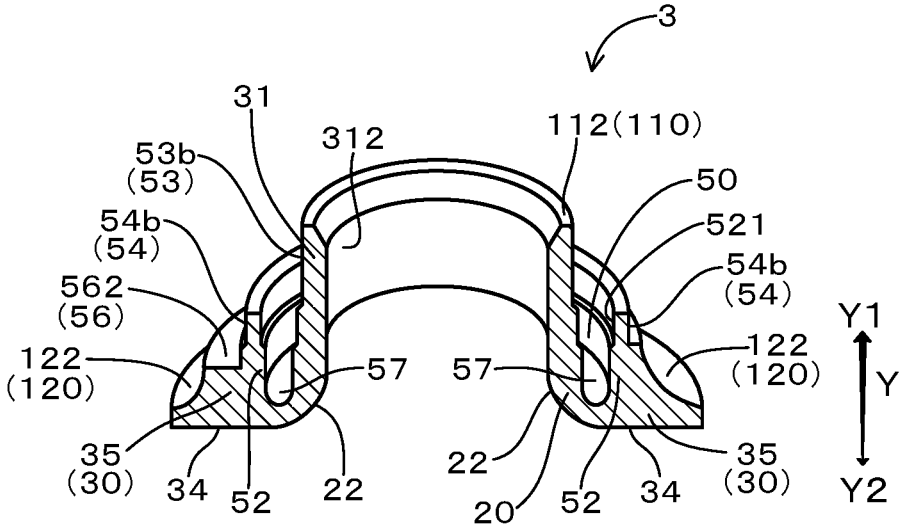
FIG. 16 is a cross-sectional perspective view of a shroud piece according to Embodiment 2.

In the housing for a turbocharger 1 according to the present embodiment, as shown in FIGS. 15 and 16, the refrigerant flow path 5 includes a cut part 57. Note that components equivalent to those in Embodiment 1 are allotted with the same reference numerals to simplify the description.

Figure 17:
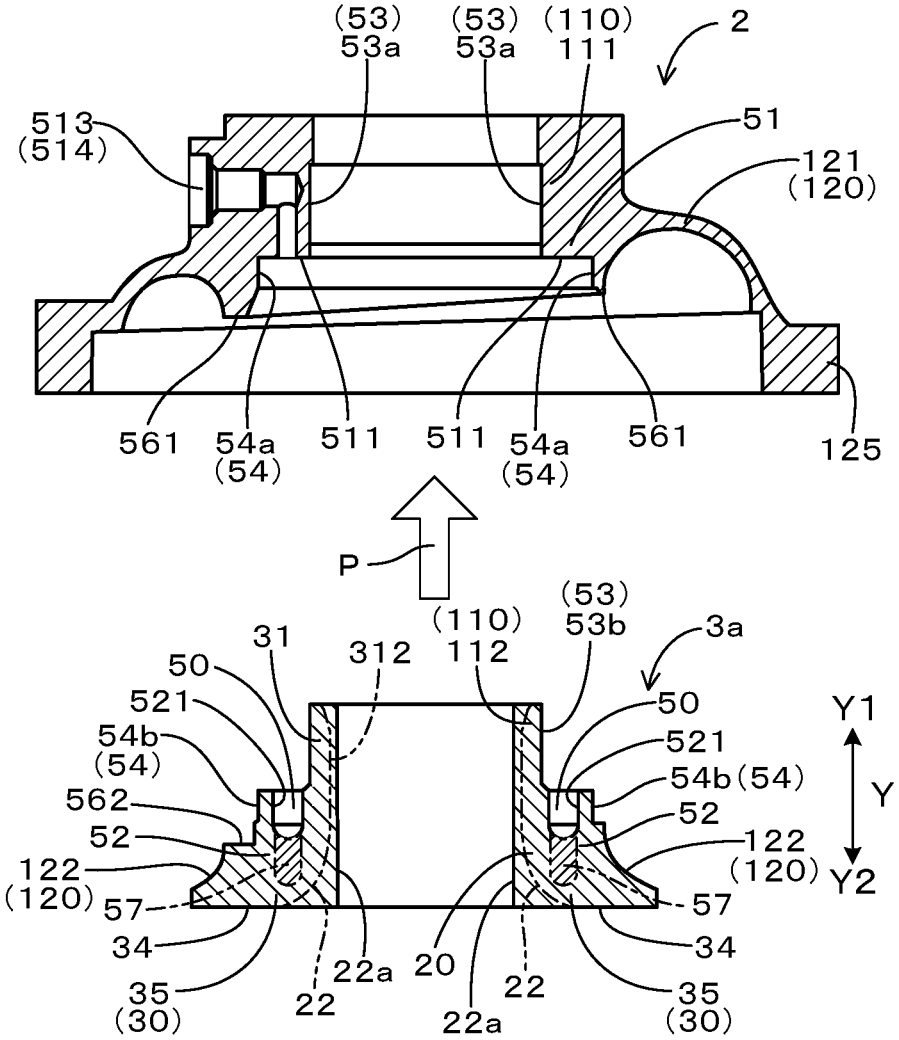
FIG. 17 is a schematic diagram for illustrating a method for manufacturing the housing for a turbocharger according to Embodiment 2.

The method for manufacturing the housing 1 for a turbocharger according to the present embodiment will be described below. As shown in FIG. 17, the molding step S1 is performed first similarly in Embodiment 1. Then, a cutting step S3 is performed as follows. The bottom of the second wall surface 521 formed from the second flow-path formation part 52, which is recessively formed toward the Y2 side, that is, part of the second wall surface 521 positioned most forward on the Y2 side is cut to form the second flow-path formation part 52 into a further recessed shape. After the cutting step S3, the assembling step S2 is performed similarly in Embodiment 1.

When the second flow-path formation part 52 is molded in a recessed shape in die-casting in the molding step S1, the diffuser part 30 is required to have a certain thickness. However, the thickness of the diffuser part 30 can be made thinner by recessively cutting the second flow-path formation part 52 after the molding step S1, so that the refrigerant flow path 5 can be formed at a position close to a diffuser surface 34. Consequently, it is possible to improve the cooling effect of the diffuser surface 34 and prevent deposit accumulation more effectively. The present embodiment also exhibits operational effects equivalent to those in Embodiment 1. In addition, the housing 1 may be of a three-piece structure in a similar way to that in Modification 2.

The present invention is not limited to the aforementioned embodiments and modifications, and can be applied to various embodiments and modifications within the scope that does not extend beyond the purposes of the present invention.

The invention claimed is:

1. A housing for a turbocharger which houses a compressor impeller, the housing comprising:

an intake port formation part that defines an intake port configured to suck in air toward the compressor impeller;

a shroud part that surrounds the compressor impeller in a circumferential direction and has a shroud surface facing the compressor impeller;

a diffuser part that is formed on an outer circumferential side of the compressor impeller in the circumferential direction and forms a diffuser passage configured to allow compressed air discharged from the compressor impeller to pass therethrough;

a scroll chamber formation part that forms a scroll chamber configured to guide the compressed air passing through the diffuser passage to outside; and a refrigerant flow path that is formed along the diffuser part in the circumferential direction, and allows a refrigerant for cooling the diffuser part to pass therethrough, wherein:

the housing is dividably composed of a scroll piece including part of the scroll chamber formation part, and a shroud piece including at least part of the intake port formation part, part of the scroll chamber formation part, the diffuser part, and the shroud part and being press-fitted into an inner side of the scroll piece in a shaft direction, the refrigerant flow path is formed as an annular space that is defined by a first flow-path formation part of the scroll piece and a second flow-path formation part of the shroud piece, the first flow-path formation part and the second flow-path formation part being formed respectively at each opposing part of the scroll piece and the shroud piece which oppose each other, the first flow path formation part and the second flow path formation part are fitted with each other at an inner circumferential seal part configured to seal the refrigerant flow path on the inner circumferential side of the refrigerant flow path and at an outer circumferential seal part configured to seal the refrigerant flow path on the outer circumferential side of the refrigerant flow path, the inner circumferential seal part is formed by press-fitting a first press-fitting portion of the shroud piece into a first press-fitted portion of the scroll piece, the outer circumferential seal part is formed by press-fitting a second press-fitting portion of the shroud piece into a second press-fitted portion of the scroll piece, and an O-ring is not interposed between the first flow path formation part and the second flow path formation part.

2. The housing for a turbocharger according to claim 1, wherein:

the first press-fitting portion includes at least part of the intake port formation part, and the first press-fitted portion is formed as an intake side press-fitted portion configured to have at least part of the intake port formation part press-fitted thereinto, and the second press-fitted portion includes part of the scroll chamber formation part, and the second press-fitting portion is formed as a scroll chamber side press-fitting portion configured to be press-fitted into the part of the scroll chamber formation part.

3. The housing for a turbocharger according to claim 1, wherein the scroll piece includes a refrigerant feed part formed of a penetration hole that communicates with the refrigerant flow path to feed the refrigerant to the refrigerant flow path, and a refrigerant discharging part formed of a penetration hole that communicates with the refrigerant flow path to discharge the refrigerant from the refrigerant flow path.

4. The housing for a turbocharger according to claim 2, wherein the scroll piece includes a refrigerant feed part formed of a penetration hole that communicates with the refrigerant flow path to feed the refrigerant to the refrigerant flow path, and a refrigerant discharging part formed of a penetration hole that communicates with the refrigerant flow path to discharge the refrigerant from the refrigerant flow path.

5. The housing for a turbocharger according to claim 1, wherein at least one of the inner circumferential seal part and the outer circumferential seal part is provided with a sealing material between the scroll piece and the shroud piece to seal a gap between the scroll piece and the shroud piece.

6. The housing for a turbocharger according to claim 2, wherein at least one of the inner circumferential seal part and the outer circumferential seal part is provided with a sealing material between the scroll piece and the shroud piece to seal a gap between the scroll piece and the shroud piece.

7. The housing for a turbocharger according to claim 3, wherein at least one of the inner circumferential seal part and the outer circumferential seal part is provided with a sealing material between the scroll piece and the shroud piece to seal a gap between the scroll piece and the shroud piece.

8. The housing for a turbocharger according to claim 4, wherein at least one of the inner circumferential seal part and the outer circumferential seal part is provided with a sealing material between the scroll piece and the shroud piece to seal a gap between the scroll piece and the shroud piece.

9. The housing for a turbocharger according to claim 1, wherein the scroll piece and the shroud piece have in common a contact portion configured to perform positioning at press-fitting by contacting the scroll piece and the shroud piece in a state of opposing in a shaft direction.

10. The housing for a turbocharger according to claim 2, wherein the scroll piece and the shroud piece have in common a contact portion that is configured to perform positioning at press-fitting by contacting the scroll piece and the shroud piece in a state of opposing in a shaft direction.

11. The housing for a turbocharger according to claim 3, wherein the scroll piece and the shroud piece have in common a contact portion that is configured to perform positioning at press-fitting by contacting the scroll piece and the shroud piece in a state of opposing in a shaft direction.

12. The housing for a turbocharger according to claim 4, wherein the scroll piece and the shroud piece have in common a contact portion that is configured to perform positioning at press-fitting by contacting the scroll piece and the shroud piece in a state of opposing in a shaft direction.

13. The housing for a turbocharger according to claim 5, wherein the scroll piece and the shroud piece have in common a contact portion that is configured to perform positioning at press-fitting by contacting the scroll piece and the shroud piece in a state of opposing in a shaft direction.

14. The housing for a turbocharger according to claim 6, wherein the scroll piece and the shroud piece have in common a contact portion that is configured to perform positioning at press-fitting by contacting the scroll piece and the shroud piece in a state of opposing in a shaft direction.

15. The housing for a turbocharger according to claim 7, wherein the scroll piece and the shroud piece have in common a contact portion that is configured to perform positioning at press-fitting by contacting the scroll piece and the shroud piece in a state of opposing in a shaft direction.

16. The housing for a turbocharger according to claim 8, wherein the scroll piece and the shroud piece have in common a contact portion that is configured to perform positioning at press-fitting by contacting the scroll piece and the shroud piece in a state of opposing in a shaft direction.

17. A method for manufacturing the housing for a turbocharger according to claim 1, the method comprising:

molding the scroll piece and the shroud piece by die-casting; and assembling the shroud piece to the scroll piece, while forming the refrigerant flow path by forming the inner circumferential seal part and the outer circumferential seal part, the inner circumferential seal part being formed by press-fitting the first press-fitting portion into the first press-fitted portion, and the outer circumferential seal part being formed by press-fitting the second press-fitting portion into the second press-fitted portion.

18. A method for manufacturing the housing for a turbocharger according to claim 16, the method comprising:

molding the scroll piece and the shroud piece by die-casting; and assembling the shroud piece to the scroll piece, while forming the refrigerant flow path by forming the inner circumferential seal part and the outer circumferential seal part, the inner circumferential seal part being formed by press-fitting the first press-fitting portion into the first press-fitted portion, and the outer circumferential seal part being formed by press-fitting the second press-fitting portion into the second press-fitted portion.

19. The method for manufacturing the housing for a turbocharger according to claim 17, further comprising cutting the second flow-path formation part of the shroud piece after the molding step and prior to the assembling step thereby recessing the second flow-path formation part, or during the molding step and prior to the assembling step thereby further recessing the second flow-path formation part already recessively molded.

20. The method for manufacturing the housing for a turbocharger according to claim 18, further comprising cutting the second flow-path formation part of the shroud piece after the molding step and prior to the assembling step thereby recessing the second flow-path formation part, or during the molding step and prior to the assembling step thereby further recessing the second flow-path formation part already recessively molded.

* * * * *